US006612199B2

(12) United States Patent
Cutshall et al.

(10) Patent No.: US 6,612,199 B2
(45) Date of Patent: Sep. 2, 2003

(54) ROCKER ARM ASSEMBLY

(75) Inventors: Mark L. Cutshall, Plymouth, MI (US); Harold J. Cebula, Livonia, MI (US)

(73) Assignee: E & E Manufacturing Company, Inc., Plymouth, MI (US)

( * ) Notice: Subject to any disclaimer, the term of this patent is extended or adjusted under 35 U.S.C. 154(b) by 0 days.

(21) Appl. No.: 09/765,933

(22) Filed: Jan. 19, 2001

(65) Prior Publication Data

US 2002/0096013 A1 Jul. 25, 2002

(51) Int. Cl.[7] ..... G05G 1/00
(52) U.S. Cl. ..... 74/559; 123/90.41
(58) Field of Search ..... 74/559, 569, 519; 123/90.39, 90.41, 90.42

(56) References Cited

U.S. PATENT DOCUMENTS

| | | | | | |
|---|---|---|---|---|---|
| 2,905,161 | A | | 9/1959 | Latham | |
| 2,919,654 | A | * | 1/1960 | Korte | 74/519 |
| 3,592,174 | A | * | 7/1971 | Heidacker | 123/90.35 |
| 3,621,823 | A | | 11/1971 | Lombardi | |
| 4,697,473 | A | | 10/1987 | Patel | |
| 4,718,379 | A | * | 1/1988 | Clark | 123/90.39 |
| 4,765,290 | A | * | 8/1988 | Tanaka | 123/90.42 |
| 4,944,257 | A | | 7/1990 | Mills | |
| 5,063,889 | A | * | 11/1991 | Pryba et al. | 123/90.39 |
| 6,027,250 | A | * | 2/2000 | Reubelt et al. | 384/2 |
| 6,227,156 | B1 | * | 5/2001 | Autrey et al. | 123/90.41 |
| 6,230,676 | B1 | * | 5/2001 | Pryba et al. | 123/90.39 |

* cited by examiner

*Primary Examiner*—Thomas R. Hannon
*Assistant Examiner*—Vicky A. Johnson
(74) *Attorney, Agent, or Firm*—Brooks & Kushman P.C.

(57) ABSTRACT

A rocker arm assembly includes a rocker arm body having opposing side walls which are connected by a bottom wall having separate first and second portions. The first portion is configured to engage a push rod and the second portion is configured to engage a valve stem. The side walls and the first and second portions of the bottom wall cooperate to form an aperture having first and second edges. A bridge is configured for snap-fit cooperation with the first and second edges, respectively. The bridge includes upstanding lips which cooperate with the opposing side walls to form first and second oil-transporting channels for transporting oil from the first portion of the bottom wall to the second portion for lubricating the rocker arm body at the point of engagement with the valve stem as the rocker arm body rocks back and forth.

15 Claims, 4 Drawing Sheets

ROCKER ARM ASSEMBLY

TECHNICAL FIELD

The present invention relates to a rocker arm assembly which includes a bridge which snaps into a rocker arm body and forms oil-transporting channels for transporting oil from one end of the rocker arm body to the other across a trunnion pedestal opening.

BACKGROUND ART

A common rocker arm design includes side walls having aligned apertures therethrough for receiving a pivotable trunnion. The opposing ends of the rocker arm are engaged against a push rod and valve stem for transmitting forces therebetween about the rotatable trunnion. Typically, the push rod forces oil into one end of the rocker arm, and the oil is required to flow from that end to the other end for lubricating the rocker arm's engagement with the valve stem. Typical cast rocker arms include a trough formed along the top of the side walls of the rocker arm for delivering oil from the push rod to the valve stem.

Recent innovative improvements in rocker arm manufacturing and design, such as that described in U.S. Pat. No. 5,887,474 and hereby incorporated by reference, have enabled the cold-forming of one-piece metal rocker arms by devising a method for cold-forming outwardly extending tubular portions in the side walls of the rocker arm. This advancement has significantly reduced manufacturing costs over prior methods, which typically required drilling or piercing of aligned apertures through side walls and installation of a support tube between the apertures. The one-piece cold-formed rocker arm, however, presents a new challenge in delivering oil from the push rod end to the valve stem end of the rocker arm because cold-formed rocker arms cannot be formed with the above-mentioned troughs for carrying oil from one end to the other.

At high engine speeds, oil is sprayed from the push rod into the interior of the rocker arm body and sufficiently lubricates the rocker arm. However, at low engine operating speeds, oil flow is reduced and pools at the push rod end of the rocker arm body. Accordingly, this oil must somehow be transported to the opposite end of the rocker arm body to lubricate the point of engagement of the rocker arm body with the valve stem.

In particular, if the trunnion is narrow in width, the oil cannot simply flow over the top of the trunnion, but must be transported.

One prior art rocker arm assembly includes a rocker arm body with a steel bridge which is spot-welded into the rocker arm body to transport oil from one end of the rocker arm body to the other. This spot welding process is, of course, an expensive operation which adds significant costs to the manufacturing and assembly operation.

Accordingly, the need exists to provide an improved rocker arm design in which oil is transported from one end of the rocker arm body to the other regardless of trunnion size.

It is further desirable that such a rocker arm assembly be compatible with a one-piece cold-formed rocker arm body design and not require spot welding or other additional, expensive manufacturing processes.

DISCLOSURE OF INVENTION

The present invention improves upon the above-referenced prior art rocker arm assemblies by providing an oil transporting bridge which is adapted for snap-fit cooperation with a rocker arm body to form oil channels for transporting oil from one end of the rocker arm body to the other end.

More specifically, the present invention provides a rocker arm assembly including a rocker arm body having opposing side walls with annular flanges extending outwardly therefrom and forming aligned bores for receiving a trunnion. The opposing side walls are connected by a bottom wall having separate first and second portions. The first portion is configured to engage a push rod and the second portion is configured to engage a valve stem. The side walls and the first and second portions of the bottom wall cooperate to form an aperture to receive a pedestal for supporting the trunnion. The aperture has first and second edges. A bridge includes first and second tabs protruding from first and second distal ends of the bridge for snap-fit cooperation with the first and second edges, respectively. The bridge is generally semi-circular in side view and has a bridge opening bordered on opposing sides by first and second upstanding lips. The first and second upstanding lips cooperate with the opposing side walls to form first and second oil-transporting channels for transporting oil from the first portion of the bottom wall to the second portion for lubricating the rocker arm body at the point of engagement with the valve stem as the rocker arm body rocks back and forth.

Preferably, the bridge is a stamped spring steel component so that the bridge is sufficiently flexible to allow the first and second distal ends to flex toward each other as the bridge is inserted into the aperture. The bridge also preferably includes first and second flanges extending along lateral edges of the bridge to add structural integrity to the bridge to prevent disengagement of the bridge from the aperture.

The rocker arm assembly includes first and second bearing shells positioned in the aligned bores. The first and second flanges abut the first and second bearing shells so that the bridge is held in position by the engagement of the tabs with the first and second edges and the engagement of the flanges with the first and second bearing shells.

Preferably, the rocker arm body is a one-piece cold-formed metal component. However, with the present invention, the rocker arm body could be cast, or a welded assembly.

Objects, features and advantages of the invention are readily apparent from the following detailed description of the best mode for carrying out the invention when taken in connection with the accompanying drawings.

DETAILED DESCRIPTION OF THE PREFERRED EMBODIMENT

The rocker arm assembly of the present invention is particularly characterized by a novel structure provided for transporting oil from the push rod end of the rocker arm body to the valve stem end of the rocker arm body. This invention is an improvement of my U.S. patent application Ser. No. 09/503,934, which is hereby incorporated by reference in its entirety, and is assigned to the assignee of the present application.

The present invention is shown and will be described with reference to FIGS. 1–9.

Figure 9:
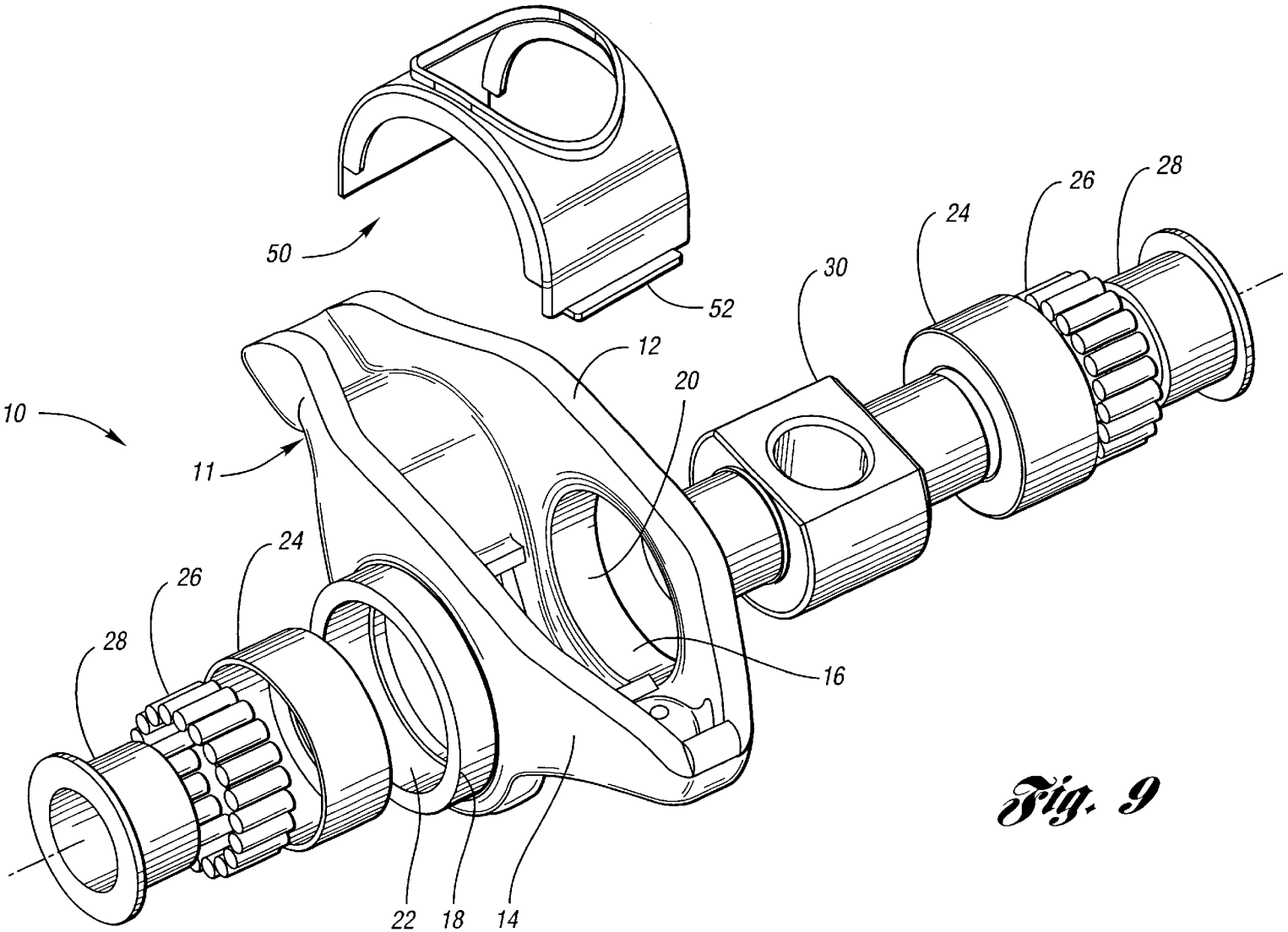
FIG. 9 shows an exploded perspective view of the rocker arm assembly of the present invention.

Referring specifically to FIG. 9, the rocker arm assembly 10 of the present invention includes a rocker arm body 11 having opposing side walls 12,14 with annular flanges 16,18 extending outwardly from the side walls 12,14, and forming aligned bores 20,22.

As shown in FIG. 9, the aligned bores 20,22 are each configured to receive a bearing shell 24, which houses needle bearings 26, and an inner race 28 for rotatably supporting a trunnion 30.

Figure 7:
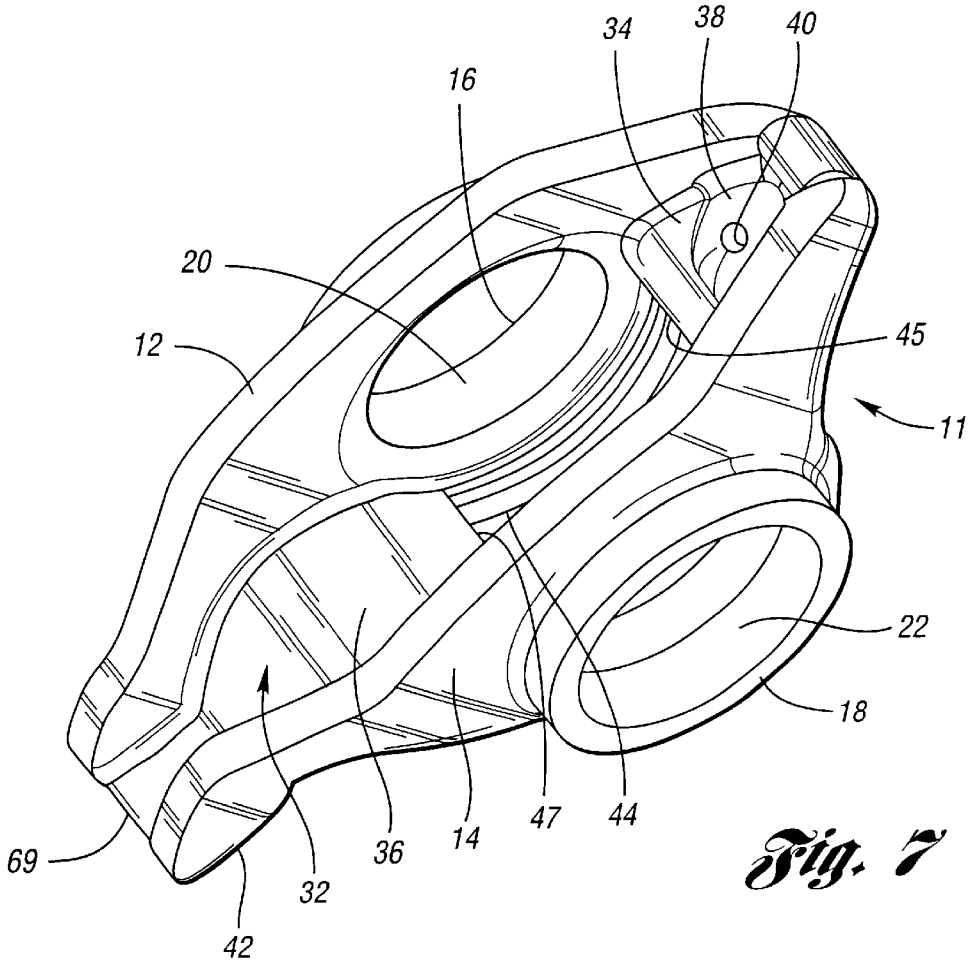
FIG. 7 shows a perspective view of a rocker arm body for use with the present invention.
Figure 8:
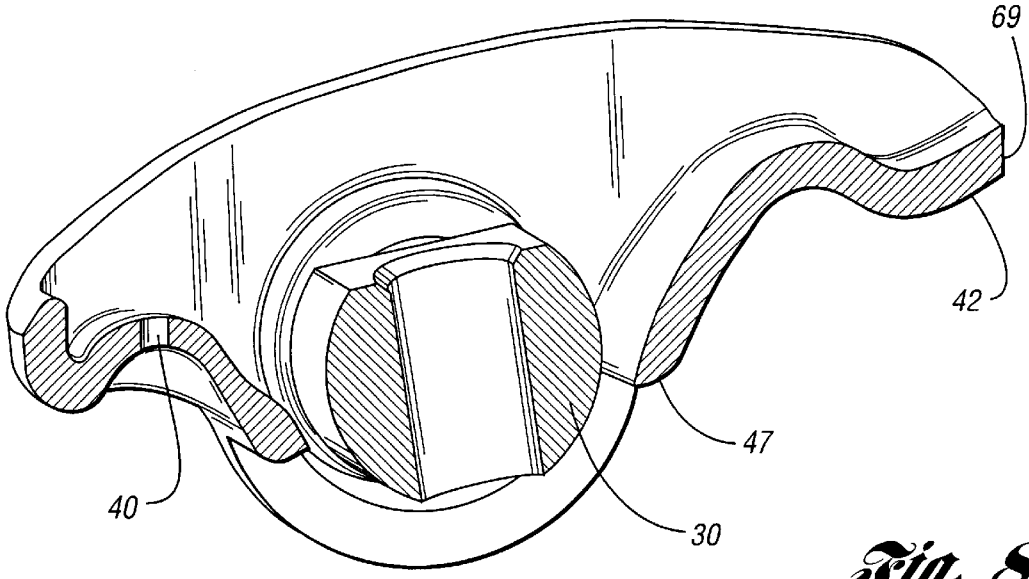
FIG. 8 shows a vertical cross-sectional view of a rocker arm body and trunnion in accordance with the invention.

Turning to FIG. 7, the opposing side walls 12,14 of the rocker arm body 11 are connected by a bottom wall 32. The bottom wall 32 has separate first and second portions 34,36 at opposing ends of rocker arm body 11. The first portion includes a pocket 38 configured to engage a push rod. The pocket 38 includes a hole 40 formed therein for receiving oil from the push rod into the interior of the rocker arm body 11.

The second portion 36 of the bottom wall 32 includes a pallet area 42 for engaging a valve stem. Accordingly, forces and movement of the valve stem and push rod are transmitted through the rocker arm body 11 by pivotal movement of the rocker arm body 11 about the trunnion 30.

The bottom edge of each side wall 12,14, and the first and second portions 34,36 of the bottom wall 32 cooperate to form an aperture 44 to receive a pedestal for supporting the trunnion 30. The pedestal 31 is shown in FIG. 4.

Figure 4:
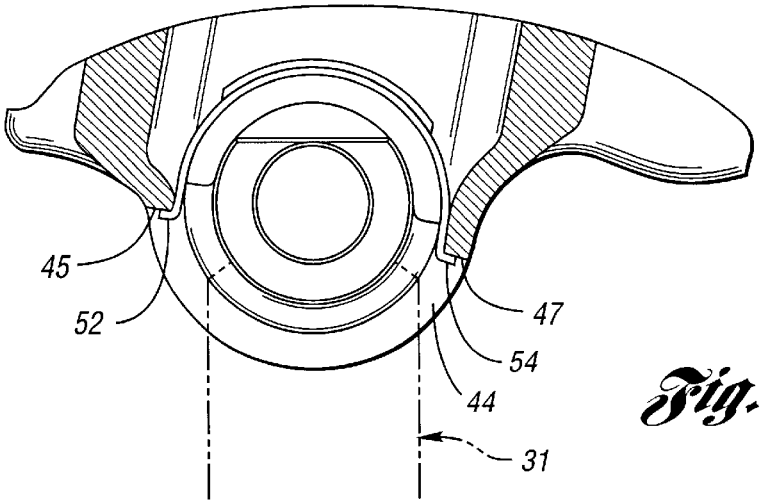
FIG. 4 shows a vertical cross-sectional view of a rocker arm assembly in accordance with the present invention.

As also shown in FIG. 4, the aperture 44 includes first and second edges 45,47.

The present invention is particularly characterized by the bridge 50 which is adapted to snap into the rocker arm body 11 to form oil-transporting channels for carrying oil from the first portion 34 to the second portion 36 of the bottom wall 32 of the rocker arm body 11, as described below.

Figure 1:
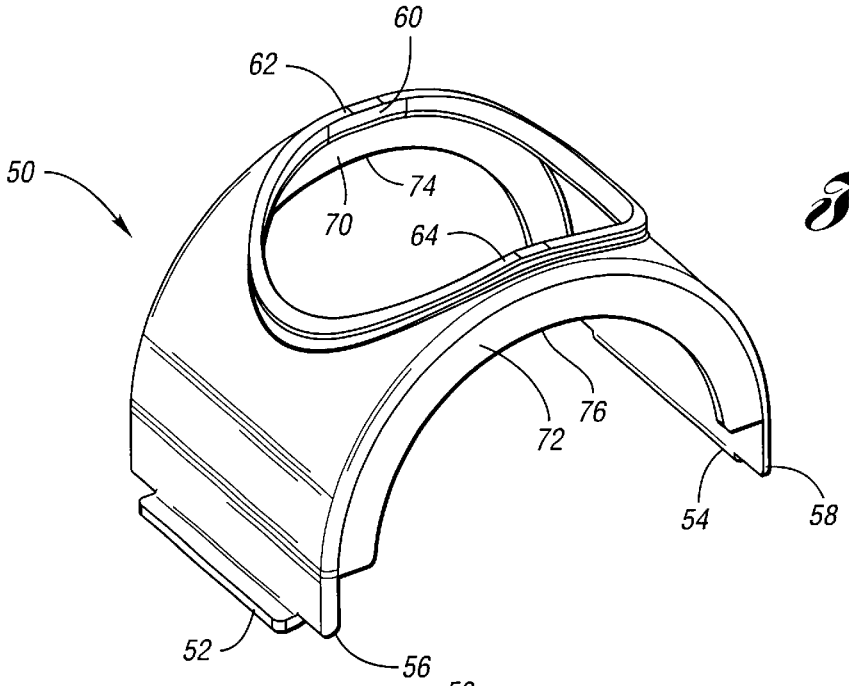
FIG. 1 shows a perspective view of a bridge in accordance with the present invention.
Figure 2:
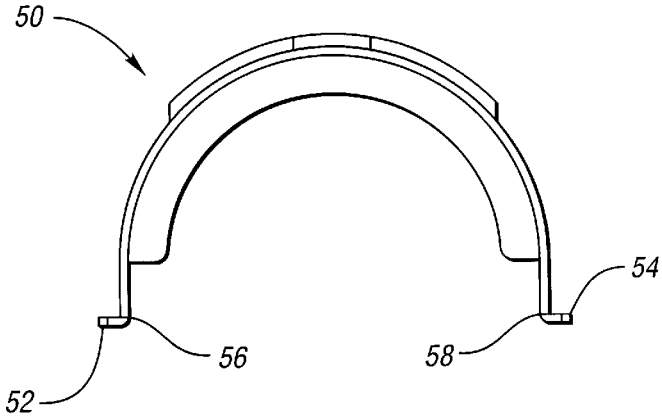
FIG. 2 shows a side view of the bridge of FIG. 1.
Figure 3:
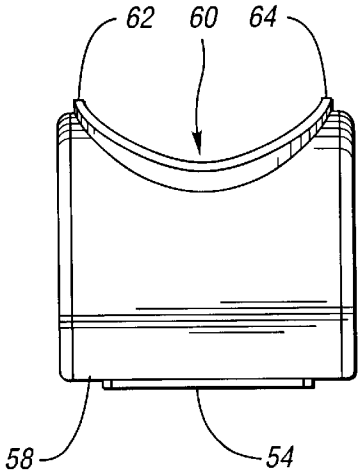
FIG. 3 shows an end view of the bridge of FIG. 1.

Referring to FIGS. 1–3, the bridge 50 includes first and second tabs 52,54 protruding from first and second distal ends 56,58, respectively, of the bridge 50 for snap-fit cooperation with the first and second edges 45,47 of the aperture 44, as shown in FIG. 4.

As viewed in FIG. 2, the bridge 50 is generally semi-circular in side view, and as shown in FIGS. 1 and 3, the bridge includes a bridge opening 60 bordered on opposing sides by first and second upstanding lips 62,64 which cooperate with the side walls 12,14 of the rocker arm body 11 to form first and second oil-transporting channels.

Figure 5:
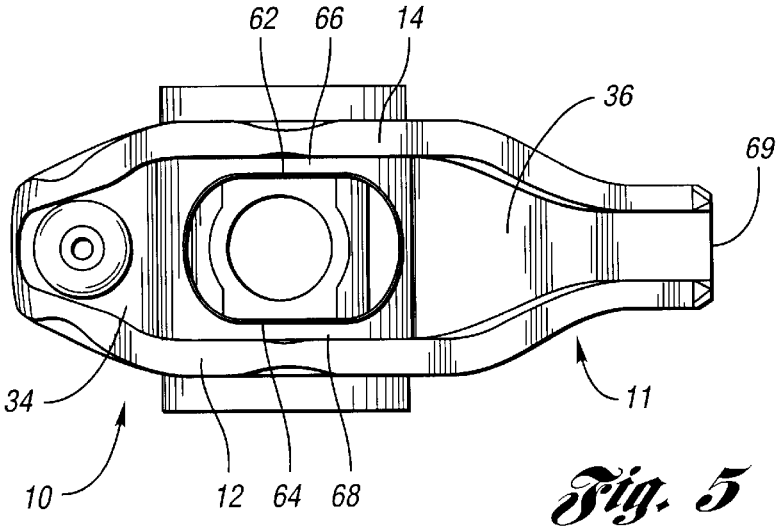
FIG. 5 shows an overhead plan view of a rocker arm assembly in accordance with the present invention.
Figure 6:
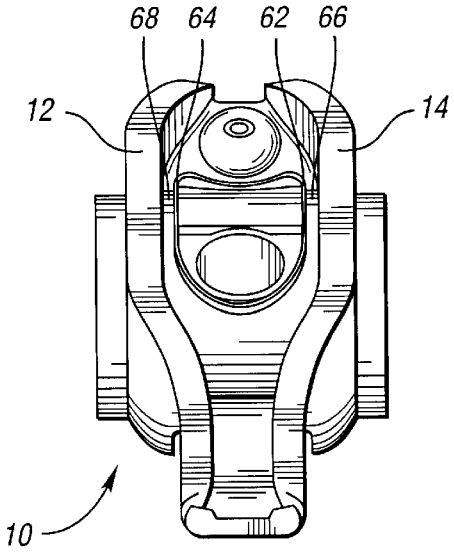
FIG. 6 shows an end view of the rocker arm assembly of FIG. 5.

The oil-transporting channels 66,68 are most clearly shown in FIGS. 5 and 6. As shown, channel 68 is formed between the side wall 12 and the upstanding lip 64. Similarly, channel 66 is formed between the side wall 14 of the rocker arm body 11 and the upstanding lip 62 of the bridge 50.

Accordingly, under low speed engine operating conditions, oil which is pooled in the first portion 34 of the bottom wall 32 of the rocker arm body 11 may be carried along the channels 66,68 to the second portion 36 of the rocker arm body 11 as the rocker arm body 11 rocks back and forth. In this manner, oil is transported to the second portion 36, from which it may travel around the distal end 69 of the body to lubricate the pallet area 42 of the rocker arm body 11. Alternatively, a hole may be provided through the second portion 36 of the body 11 to transport oil to the pallet area 42 of the rocker arm body 11 to lubricate the pallet area at the point of engagement with the valve stem as the rocker arm body rocks back and forth.

Preferably, the bridge is a stamped spring steel component so that the bridge is sufficiently flexible to allow the first and second distal ends 56,58 to flex toward each other as the bridge 50 is inserted into the aperture 44.

As shown in FIG. 1, the bridge 50 also includes first and second flanges 70,72 extending along lateral edges of the bridge 50 to add structural integrity to the bridge 50 to prevent disengagement of the bridge 50 from the aperture 44. In the final assembly, the flanges 70,72 are substantially parallel with the side walls 12,14 of the rocker arm body 11. The edges 74,76 of the flanges 70,72 abut the bearing shells 24.

Accordingly, the bridge 50 is secured to the body 11 by an interference fit between the tabs 52,54 and the respective edges 45,47 of the aperture 44. The abutment of the edges 74,76 of the flanges 70,72 against the bearing sleeves 24 prevents movement of the bridge in the downward direction, as viewed in FIG. 4, through the aperture 44.

In this configuration, as viewed in FIG. 9, the bearing shells 24, needle bearings 26, inner races 28, and trunnion 30 are inserted into the bores 20,22 prior to installation of the bridge 50 downward (as viewed in FIG. 9) over the trunnion 30 so that the tabs 52,54 are snapped into engagement with the edges of the aperture 40 and the edges 74,76 of the flanges 70,72 abut the bearing shells 24.

While the best mode for carrying out the invention has been described in detail, those familiar with the art to which this invention relates will recognize various alternative designs and embodiments for practicing the invention within the scope of the appended claims.

What is claimed is:

1. A rocker arm assembly comprising:

a rocker arm body having opposing side walls with annular flanges extending outwardly therefrom and forming aligned bores for receiving a trunnion, said opposing side walls being connected by a bottom wall having separate first and second portions, said first portion being configured to engage a push rod and said second portion being configured to engage a valve stem, wherein said side walls and said first and second portions of the bottom wall cooperate to form an aperture to receive a pedestal for supporting the trunnion, said aperture having first and second edges; and a bridge having first and second tabs protruding from first and second distal ends of the bridge for snap-fit cooperation with the first and second edges, respectively, said bridge being generally semi-circular in side view and having a bridge opening bordered on opposing sides by first and second upstanding lips which cooperate with the opposing side walls to form first and second oil-transporting channels for transporting oil from the first portion of the bottom wall to the second portion for lubricating the rocker arm body at the point of said engagement with the valve stem as the rocker arm body rocks back and forth.

2. The rocker arm assembly of claim 1, wherein said bridge comprises stamped spring steel so that the bridge is sufficiently flexible to allow the first and second distal ends to flex toward each other as the bridge is inserted into the aperture.

3. Th rocker arm assembly of claim 1, further comprising first and second flanges extending along lateral edges of the bridge to add structural integrity to the bridge to prevent disengagement of the bridge from the aperture.

4. The rocker arm assembly of claim 3, further comprising first and second bearing shells in the aligned bores, wherein the first and second flanges abut the first and second bearing shells, respectively.

5. The rocker arm assembly of claim 4, wherein said first and second flanges are substantially parallel to said opposing side walls.

6. The rocker arm assembly of claim 1, wherein said rocker arm body comprises a one-piece cold-formed metal component.

7. A rocker arm assembly comprising:

a rocker arm body having opposing side walls with annular flanges extending outwardly therefrom and forming aligned bores for receiving a trunnion, said opposing side walls being connected by a bottom wall having separate first and second portions, said first portion being configured to engage a push rod and said second portion being configured to engage a valve stem, wherein said side walls and said first and second portions of the bottom wall cooperate to form an aperture to receive a pedestal for supporting the trunnion; and a bridge configured for snap-fit cooperation with the rocker arm body and including at least one upstanding lip which cooperates with at least one of the opposing side walls to form at least one oil-transporting channel for transporting oil from the first portion of the bottom wall to the second portion of the bottom wall for lubricating the rocker arm body at the point of said engagement with the valve stem as the rocker arm body rocks back and forth.

8. The rocker arm assembly of claim 7, wherein said aperture has first and second edges, and the bridge has first and second tabs protruding from first and second distal ends of the bridge for snap-fit cooperation with the first and second edges, respectively.

9. The rocker arm assembly of claim 8, wherein said bridge is generally semi-circular in side view, and said at least one upstanding lip comprises first and second upstanding lips which cooperate with the opposing side walls to form first and second oil-transporting channels.

10. The rocker arm assembly of claim 8, wherein said bridge comprises stamped spring steel so that the bridge is sufficiently flexible to allow the first and second distal ends to flex toward each other as the bridge is inserted into the aperture.

11. The rocker arm assembly of claim 8, further comprising first and second flanges extending along lateral edges of the bridge to add structural integrity to the bridge to prevent disengagement of the bridge from the aperture.

12. The rocker arm assembly of claim 11, further comprising first and second bearing shells in the aligned bores, wherein the first and second flanges abut the first and second bearing shells, respectively.

13. The rocker arm assembly of claim 12, wherein said first and second flanges are substantially parallel to said opposing side walls.

14. The rocker arm assembly of claim 8, wherein said first and second tabs have an interference fit with said first and second edges, respectively, so that the bridge does not rattle within the rocker arm body.

15. The rocker arm assembly of claim 7, wherein said rocker arm body comprises a one-piece cold-formed metal component.

* * * * *